US007901339B2

(12) United States Patent
Schechter

(10) Patent No.: US 7,901,339 B2
(45) Date of Patent: Mar. 8, 2011

(54) DEVICE AND METHOD FOR OCCUPYING A HUMAN SUBJECT WITH PHYSICAL AND MENTAL ACTIVITIES

(76) Inventor: Nir Schechter, Doar-Na Emek Beit SheAn (IL)

( * ) Notice: Subject to any disclaimer, the term of this patent is extended or adjusted under 35 U.S.C. 154(b) by 831 days.

(21) Appl. No.: 11/658,649

(22) PCT Filed: Jul. 26, 2005

(86) PCT No.: PCT/IL2005/000800

§ 371 (c)(1),
(2), (4) Date: Jan. 26, 2007

(87) PCT Pub. No.: WO2006/011147

PCT Pub. Date: Feb. 2, 2006

(65) Prior Publication Data

US 2009/0005187 A1 Jan. 1, 2009

Related U.S. Application Data

(60) Provisional application No. 60/590,921, filed on Jul. 26, 2004.

(51) Int. Cl.
*A63B 26/00* (2006.01)

(52) U.S. Cl. ..... 482/142; 482/34; 482/146

(58) Field of Classification Search ..... 482/34, 482/66, 93, 126, 123, 142, 148
See application file for complete search history.

(56) References Cited

U.S. PATENT DOCUMENTS 3,785,643 A * 1/1974 Rich ..... 482/86
5,833,587 A * 11/1998 Strong et al. ..... 482/123
6,461,284 B1 10/2002 Francavilla
6,702,388 B1 * 3/2004 Chiu ..... 297/452.41
6,702,726 B2 * 3/2004 Lin ..... 482/148
6,730,005 B1 * 5/2004 Liao ..... 482/142
6,746,372 B2 * 6/2004 Hsu ..... 482/34
6,837,835 B2 * 1/2005 Huang ..... 482/126
6,945,919 B2 * 9/2005 Yang ..... 482/142
D521,084 S * 5/2006 Huang ..... D21/662
7,044,558 B2 * 5/2006 Chiu ..... 297/452.41
7,141,011 B2 * 11/2006 Williams et al. ..... 482/148
7,306,550 B2 * 12/2007 Lin ..... 482/142
7,311,644 B2 * 12/2007 Hale ..... 482/142
7,588,522 B2 * 9/2009 Heitzman ..... 482/142
7,624,461 B2 * 12/2009 Tidwell et al. ..... 5/655
2001/0001094 A1 * 5/2001 Panes ..... 482/93

* cited by examiner

*Primary Examiner* — Glenn Richman
(74) *Attorney, Agent, or Firm* — Mark M. Friedman

(57) ABSTRACT

Device and method for occupying a human subject with physical and mental activities. Includes (a) human mountable and movable object (12) having total volume in a range of between about 0.5 and 5 cubic meters and being sufficiently strong to bear weight of a human subject (5) when mounted thereupon; (b) object motion control assembly (16, 18, 20, 22, 24) operatively connected to object (12), for controlling motion of object (12) when human subject (5) is mounted upon object (12); and (c) base assembly (30, 32) operatively connected to the object motion control assembly, for anchoring the object motion control assembly when human subject (5) is mounted upon object (5) and moving upon object (12) within a field of space determined by characteristics, configuration, and dimensions, of object (12), the object motion control assembly, base assembly (30), and behavior of human subject (5).

7 Claims, 10 Drawing Sheets

DEVICE AND METHOD FOR OCCUPYING A HUMAN SUBJECT WITH PHYSICAL AND MENTAL ACTIVITIES

RELATED APPLICATIONS

This Application is a National Phase of PCT Patent Application No. PCT/IL2005/000800 having International Filing Date of Jul. 26, 2005, which claims the benefit of U.S. Provisional Patent Application No. 60/590,921 filed on Jul. 26, 2004. The contents of the above Applications are all incorporated herein by reference.

FIELD AND BACKGROUND OF THE INVENTION

The present invention relates to a device and corresponding method using thereof, for occupying a human subject with physical and mental activities. The physical and mental activities occupied by the human subject encompass a wide range of applications in a variety of different fields, particularly, the fields of play, entertainment, education, fitness or exercise, therapy, or/and development. The present invention features unique integration, inter-connections, and interactions, of a human mountable and movable object, such as a ball or a toy animal, an object motion control assembly, such as a harness and straps, and a base assembly, such as a mat. A human subject mounted upon the object is able to controllably and safely move on the statically held object, or, alternatively, move on and with the dynamically moving object, within a field of space determined by characteristics, configuration, and dimensions, of the object, the object motion control assembly, and the base assembly, and according to the physical and mental desires and capabilities of the human subject.

The present invention is primarily directed to a ball or toy animal type of object based device and corresponding method of using thereof. However, the present invention can be generally implemented by including any of a wide variety of different types of a human mountable and movable object (instead of a ball or toy animal type of object), encompassing a wide range of applications in a variety of different fields, particularly, the fields of (mental or/and physical) play, entertainment, education, fitness or exercise, therapy, or/and development.

Invention, uses, and advantages thereof, of the ball were revealed thousands of years ago, and with progression of time, there was a corresponding progression of new uses of the ball for a variety of different purposes in a variety of different fields. For example, about fifty years ago, a couple of young physical therapists introduced therapeutic use of the ball to the field of physical therapy. As with circumstances and events surrounding many revolutionary or non-conventional scientific/medical breakthroughs, following introduction of therapeutic use of the ball to the world of physical therapy and treatment there were complications in the beginning, and it took time for use of the ball to take hold and eventually enter academia and physical therapy related professional occupations.

In the 1980's, there was a significantly meaningful advancement regarding therapeutic use of the ball, during which time there was introduced the 'Physioball', which eventually became well known and used in the physical therapy areas of treatment, development, and rehabilitation. The Physioball is typically commercially available in the form of a stand-alone inflatable rubber ball having a diameter between about one and three feet and being sufficiently strong to bear the weight of a human subject. A physical therapist designs various different exercises based on use of the Physioball, for example, involving a patient to manipulate the ball and/or to mount their body upon the ball and move in different directions while mounted on the ball.

In addition to therapeutic use of the Physioball in the field of physical therapy, the Physioball can also be used by persons not particularly needing physical therapy. For example, the Physioball can be used for exercising the body in order to achieve or/and maintain physical fitness. Additionally, the Physioball can be used by persons, especially children, although in a relatively limited manner, for play or entertainment, for example, by playing ball based games.

Although the Physioball is currently widely used in the field of physical therapy, and is also applicable to other fields, such as physical fitness, play, and entertainment, there continues to be a need for identifying, developing, and implementing, new devices, and corresponding method using such devices, which can be applied in these and other fields which focus on occupying a human subject with physical and mental activities.

There is thus a need for, and it would be highly advantageous to have a device and corresponding method using thereof, for occupying a human subject with physical and mental activities. There is a need for such an invention wherein the physical and mental activities occupied by the human subject encompass a wide range of applications in a variety of different fields, particularly, the fields of (mental or/and physical) play, entertainment, education, fitness or exercise, therapy, or/and development. Moreover, there is a need for such an invention which is applicable to persons in different age groups, for example, infants, children, young adults, middle aged adults, and the elderly. Additionally, there is a need for such an invention which is safe and simple to use, is not readily breakable, and which is relatively inexpensive to manufacture.

SUMMARY OF THE INVENTION

The present invention relates to a device and corresponding method using thereof, for occupying a human subject with physical and mental activities. The physical and mental activities occupied by the human subject encompass a wide range of applications in a variety of different fields, particularly, the fields of (mental or/and physical) play, entertainment, education, fitness or exercise, therapy, or/and development.

The present invention features unique integration, interconnections, and interactions, of a human mountable and movable object, such as a ball or a toy animal, an object motion control assembly, such as a harness and straps, and a base assembly, such as a mat. A human subject mounted upon the object is able to controllably and safely move on the statically held object, or, alternatively, move on and with the dynamically movable object, within a field of space determined by characteristics, configuration, and dimensions, of the object, the object motion control assembly, and the base assembly, and according to the behavior (mental or/and physical desires and capabilities) of the human subject. As a result of operative connections among the object, the object motion control assembly, and the base assembly, when the human subject is mounted upon the object, the human subject and the object can freely rotate around a vertical axis of the object, as well as freely move with the object in a rocking or swinging motion relative to a vertical axis of the object.

The device of the present invention optionally includes various additional components and elements. For example, the device optionally includes an infant harness assembly, which includes an appropriate combination of straps, bands, cords, belts, connecting elements, and size adjusting elements, for holding an infant in a position with front, back, or side, upon the object, or in a sitting position, when mounted upon, and moving on the statically held object, or, alternatively, moving on and with the dynamically moving object. Additionally, for example, the device optionally includes play or/and educational or learning objects or accessories, for further occupying the human subject with physical and mental activities which are applicable in a variety of different fields, particularly, the fields of play, entertainment, education, fitness or exercise, therapy, or/and development.

The present invention is applicable to human subjects in different age groups, for example, infants, children, young adults, middle aged adults, and the elderly. Additionally, the present invention is safe and simple to use, is not readily breakable, and is relatively inexpensive to manufacture.

The present invention is primarily directed to a ball or toy animal type of object based device and corresponding method of using thereof. However, it is to be fully understood that in a non-limiting manner the present invention can be generally implemented by including any of a wide variety of different types of a human mountable and movable object (instead of a ball or toy animal type of object), encompassing a wide range of applications in a variety of different fields, particularly, the fields of (mental or/and physical) play, entertainment, education, fitness or exercise, therapy, or/and development.

Thus, according to the present invention, there is provided a device for occupying a human subject with physical and mental activities, comprising: (a) a human mountable and movable object having a total volume in a range of between about 0.5 cubic meters and about 5 cubic meters and being sufficiently strong to bear weight of the human subject when the human subject is mounted thereupon; (b) an object motion control assembly operatively connected to the object, for controlling motion of the object when the human subject is mounted upon the object; and (c) a base assembly operatively connected to the object motion control assembly, for anchoring the object motion control assembly when the human subject is mounted upon the object and moving upon the object within a field of space determined by characteristics, configuration, and dimensions, of the object, the object motion control assembly, the base assembly, and according to behavior of the human subject.

According to another aspect of the present invention, there is provided a method for occupying a human subject with physical and mental activities, comprising: (a) providing the human subject with a device which comprises: (i) a human mountable and movable object having a total volume in a range of between about 0.5 cubic meters and about 5 cubic meters and being sufficiently strong to bear weight of the human subject when the human subject is mounted and moving thereupon; (ii) an object motion control assembly operatively connected to the object, for controlling motion of the object when the human subject is mounted and moving upon the object; and (iii) a base assembly operatively connected to the object motion control assembly, for anchoring the object motion control assembly when the human subject is mounted and moving upon the object; (b) mounting of the human subject upon the object; and (c) moving of the human subject while mounted upon the object, within a field of space determined by characteristics, configuration, and dimensions, of the object, the object motion control assembly, the base assembly, and according to behavior of the human subject.

BRIEF DESCRIPTION OF THE DRAWINGS

The present invention is herein described, by way of example only, with reference to the accompanying drawings. With specific reference now to the drawings in detail, it is stressed that the particulars shown are by way of example and for purposes of illustrative description of the preferred embodiments of the present invention only, and are presented in the cause of providing what is believed to be the most useful and readily understood description of the principles and conceptual aspects of the present invention. In this regard, no attempt is made to show structural details of the present invention in more detail than is necessary for a fundamental understanding of the invention, the description taken with the drawings making apparent to those skilled in the art how the several forms of the invention may be embodied in practice. In the drawings.

DESCRIPTION OF THE PREFERRED EMBODIMENTS

Figure 1:
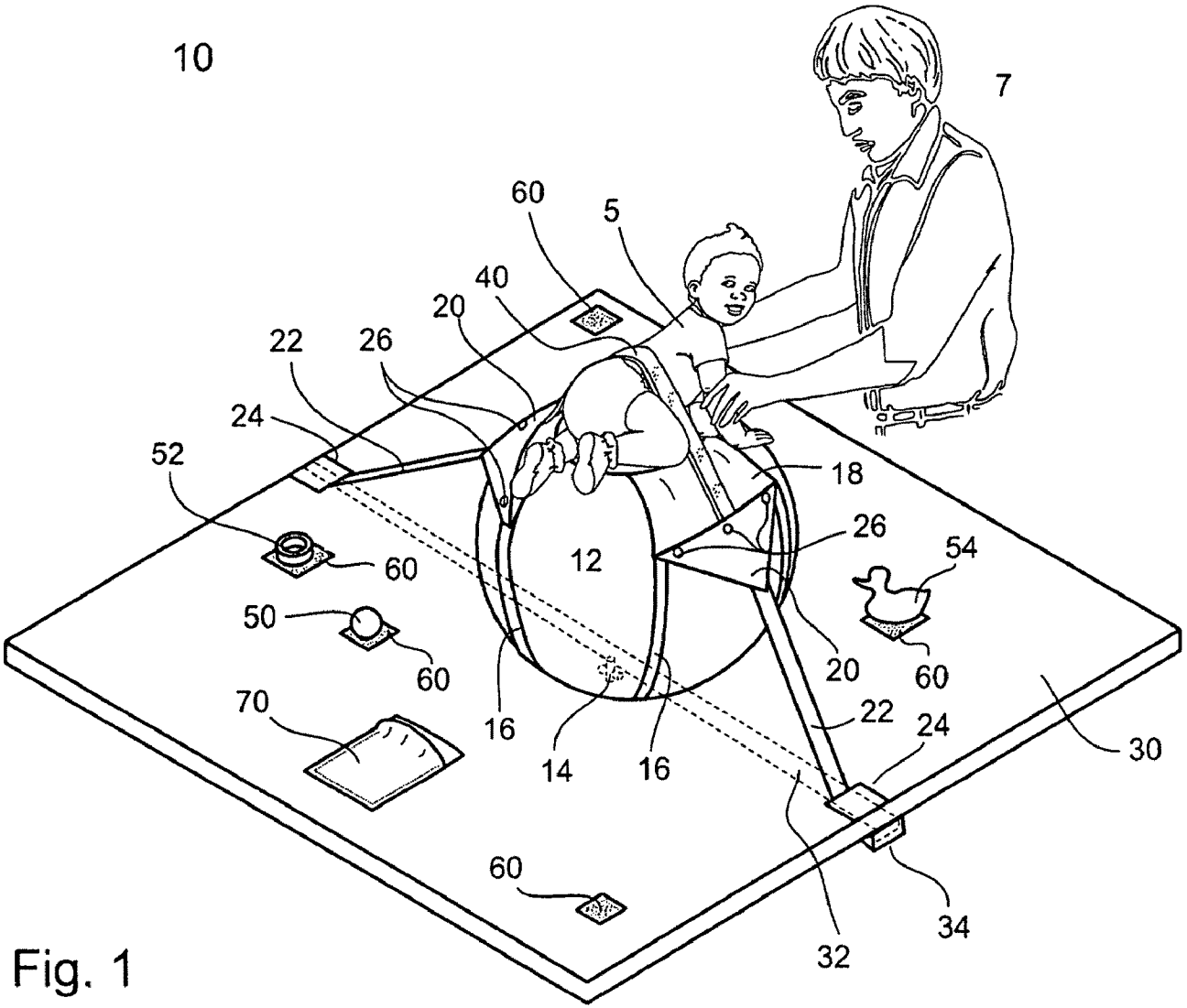
FIG. 1 is a schematic diagram illustrating a perspective view of an exemplary preferred embodiment of the device, and an exemplary preferred embodiment of the method, of the present invention, for occupying a human subject with physical and mental activities, wherein the human mountable and movable object is a ball, and wherein the human subject is an infant assisted and supervised by an adult, in accordance with the present invention.

The present invention relates to a device and corresponding method using thereof, for occupying a human subject with physical and mental activities. The physical and mental activities occupied by the human subject encompass a wide range of applications in a variety of different fields, particularly, the fields of (mental or/and physical) play, entertainment, education, fitness or exercise, therapy, or/and development.

The present invention features unique integration, interconnections, and interactions, of a human mountable and movable object, such as a ball or a toy animal, an object motion control assembly, such as a harness and straps, and a base assembly, such as a mat. A human subject mounted upon the object is able to controllably and safely move on the statically held object, or, alternatively, move on and with the dynamically movable object, within a field of space determined by characteristics, configuration, and dimensions, of the object, the object motion control assembly, and the base assembly, and according to the behavior (mental or/and physical desires and capabilities) of the human subject. As a result of operative connections among the object, the object motion control assembly, and the base assembly, when the human subject is mounted upon the object, the human subject and the object can freely rotate around a vertical axis of the object, as well as freely move with the object in a rocking or swinging motion relative to a vertical axis of the object.

The device of the present invention optionally includes various additional components and elements. For example, the device optionally includes an infant harness assembly, which includes an appropriate combination of straps, bands, cords, belts, connecting elements, and size adjusting elements, for holding an infant in a position with front, back, or side, upon the object, or in a sitting position, when mounted upon, and moving on the statically held object, or, alternatively, moving on and with the dynamically moving object. Additionally, for example, the device optionally includes play or/and educational or learning objects or accessories, for further occupying the human subject with physical and mental activities which are applicable in a variety of different fields, particularly, the fields of play, entertainment, education, fitness or exercise, therapy, or/and development.

The present invention is applicable to human subjects in different age groups, for example, infants, children, young adults, middle aged adults, and the elderly. Additionally, the present invention is safe and simple to use, is not readily breakable, and is relatively inexpensive to manufacture.

The present invention is primarily directed to a ball or toy animal type of object based device and corresponding method of using thereof. However, it is to be fully understood that in a non-limiting manner the present invention can be generally implemented by including any of a wide variety of different types of a human mountable and movable object (instead of a ball or toy animal type of object), encompassing a wide range of applications in a variety of different fields, particularly, the fields of (mental or/and physical) play, entertainment, education, fitness or exercise, therapy, or/and development.

The device for occupying a human subject with physical and mental activities, of the present invention, includes the following main components and functionalities thereof: (a) a human mountable and movable object having a total volume in a range of between about 0.5 cubic meters and about 5 cubic meters and being sufficiently strong to bear weight of the human subject when the human subject is mounted thereupon; (b) an object motion control assembly operatively connected to the object, for controlling motion of the object when the human subject is mounted upon the object; and (c) a base assembly operatively connected to the object motion control assembly, for anchoring the object motion control assembly when the human subject is mounted upon the object and moving upon the object within a field of space determined by characteristics, configuration, and dimensions, of the object, the object motion control assembly, the base assembly, and according to behavior of the human subject.

The corresponding method for occupying a human subject with physical and mental activities, of the present invention, includes the following main steps and components thereof: (a) providing the human subject with a device which comprises: (i) a human mountable and movable object having a total volume in a range of between about 0.5 cubic meters and about 5 cubic meters and being sufficiently strong to bear weight of the human subject when the human subject is mounted and moving thereupon; (ii) an object motion control assembly operatively connected to the object, for controlling motion of the object when the human subject is mounted and moving upon the object; and (iii) a base assembly operatively connected to the object motion control assembly, for anchoring the object motion control assembly when the human subject is mounted and moving upon the object; (b) mounting of the human subject upon the object; and (c) moving of the human subject while mounted upon the object, within a field of space determined by characteristics, configuration, and dimensions, of the object, the object motion control assembly, the base assembly, and according to behavior of the human subject.

There are three preferred alternative modes or ways of performing Step (c) of the method, primarily depending upon the extent that the motion of object 12 is controlled by the object motion control assembly—a fixed or static mode, a semi-dynamic mode, and a fully-dynamic mode.

According to the first mode, being a fixed or static mode, of performing Step (c), the object is held completely fixed or static by the object motion control assembly, in a manner whereby the object remains essentially fixed or static and motionless, and is essentially non-rotatable and non-rockable by the human subject, when the human subject is mounted upon the object and moves upon the object.

According to the second mode, being a semi-dynamic mode, of performing Step (c), the object is held by the object motion control assembly, in a manner whereby the object is partly rotatable and partly rockable by the human subject, when the human subject is mounted upon the object and moves upon the object.

According to the third mode, being a fully-dynamic mode, of performing Step (c), the object is only held at a single point of connection, in particular, at the bottom center of the object by a rotatable connecting element of the object motion control assembly, in a manner whereby the object is fully rotatable around a vertical axis of the object and is fully rockable relative to a vertical axis of the object, by the human subject, when the human subject is mounted upon the object and moves upon and with the object. The fully-dynamic mode of Step (c) is performed in a manner such that when the human subject is mounted upon the object, the human subject and the object can freely rotate around a vertical axis of the object, as well as freely move with the object in a rocking or swinging motion relative to a vertical axis of the object.

A first main aspect of the present invention is provision of a device which features unique integration, inter-connections, and interactions, of a human mountable and movable object, such as a ball or a toy animal, an object motion control assembly, such as a harness and straps, and a base assembly, such as a mat.

A second main aspect of the present invention is provision of a method whereby a human subject mounted upon the object is able to controllably and safely move on the statically held object, or, alternatively, move on and with the dynamically movable object, within a field of space determined by characteristics, configuration, and dimensions, of the object, the object motion control assembly, and the base assembly, and according to the behavior (mental or/and physical desires and capabilities) of the human subject.

A third main aspect of the present invention is that during implementation, as a result of operative connections among the object, the object motion control assembly, and the base assembly, when the human subject is mounted upon the object, the human subject and the object can freely rotate around a vertical axis of the object, as well as freely move with the object in a rocking or swinging motion relative to a vertical axis of the object.

A fourth main aspect of the present invention is that the device optionally includes various additional components and elements, for example, an infant harness assembly for holding an infant in various different positions when mounted upon, and moving on the statically held object, or, alternatively, moving on and with the dynamically moving object, and for example, play or/and educational or learning objects or accessories, for further occupying the human subject with physical and mental activities which are applicable in a variety of different fields, particularly, the fields of play, entertainment, education, fitness or exercise, therapy, or/and development.

A fifth main aspect of the present invention is applicability to human subjects in different age groups, for example, infants, children, young adults, middle aged adults, and the elderly.

A sixth main aspect of the present invention is that it is safe and simple to use, is not readily breakable, and is relatively inexpensive to manufacture.

A seventh main aspect of the present invention is that even though the present invention is primarily directed to a ball or toy animal type of object based device and corresponding method of using thereof, in a non-limiting manner the present invention can be generally implemented by including any of a wide variety of different types of a human mountable and movable object (instead of a ball or toy animal type of object), encompassing a wide range of applications in a variety of different fields, particularly, the fields of (mental or/and physical) play, entertainment, education, fitness or exercise, therapy, or/and development.

It is to be understood that the present invention is not limited in its application to the details of type, composition, construction, arrangement, order, and number, of the assemblies, sub-assemblies, structures, components, elements, and materials, of the device, or to the details of the order or sequence, number, of procedures, steps, and sub-steps, of operation of the device, or of the method, set forth in the following illustrative description, accompanying drawings, and examples, unless otherwise specifically stated herein. For example, the following illustrative description features a ball or toy animal type of object based device and corresponding method of using thereof, in order to illustrate implementation of the present invention. It is to be fully understood that in a non-limiting manner the present invention can be generally implemented by including any of a wide variety of different types of a human mountable and movable object, instead of a ball or toy animal type of object. Accordingly, the present invention is capable of other embodiments and of being practiced or carried out in various ways. Although assemblies, sub-assemblies, structures, components, elements, and materials, and, procedures, steps, sub-steps, similar or equivalent to those illustratively described herein can be used for practicing or testing the present invention, suitable assemblies, sub-assemblies, structures, components, elements, and materials, and procedures, steps, sub-steps, are illustratively described herein.

It is also to be understood that all technical and scientific words, terms, or/and phrases, used herein throughout the present disclosure have either the identical or similar meaning as commonly understood by one of ordinary skill in the art to which this invention belongs, unless otherwise specifically defined or stated herein. Phraseology, terminology, and, notation, employed herein throughout the present disclosure are for the purpose of description and should not be regarded as limiting. It is to be fully understood that the terms 'connectable', 'connected', and 'connecting', are generally used herein, and also may refer to the corresponding synonymous terms 'joinable', 'joined', and 'joining', as well as 'attachable', 'attached', and 'attaching'. Moreover, all technical and scientific words, terms, or/and phrases, introduced, defined, described, or/and exemplified, in the above Background section, are equally or similarly applicable in the illustrative description of the preferred embodiments, examples, and appended claims, of the present invention. Additionally, as used herein, the term 'about' refers to ±10% of the associated value.

Assemblies, sub-assemblies, mechanisms, structures, components, elements, materials, procedures, steps, sub-steps, operation, and implementation, of exemplary preferred embodiments, alternative preferred embodiments, specific configurations, and, additional and optional aspects, characteristics, or features, thereof, of a device and corresponding method using thereof, for occupying a human subject with physical and mental activities, according to the present invention, are better understood with reference to the following illustrative description and accompanying drawings. Throughout the following illustrative description and accompanying drawings, same reference numbers refer to same assemblies, sub-assemblies, structures, components, or elements.

In the following illustrative description of the present invention, included are main or principal assemblies, sub-assemblies, structures, components, elements, and materials, and functions thereof, and, main or principal procedures, steps, and sub-steps, needed for sufficiently understanding proper 'enabling' utilization and implementation of the disclosed device and method. Accordingly, description of various possible required or/and optional preliminary, intermediate, minor, assemblies, sub-assemblies, structures, components, elements, or/and materials, or/and functions thereof, or/and, procedures, steps, or/and sub-steps, which are readily known by one of ordinary skill in the art, which are available in the prior art or/and technical literature are at most only briefly indicated herein.

The device for occupying a human subject with physical and mental activities, of the present invention, is herein illustratively described as follows, along with reference to FIGS. 1-4, and further exemplified in FIGS. 5-10 in Examples 1-5, hereinbelow.

Figure 2:
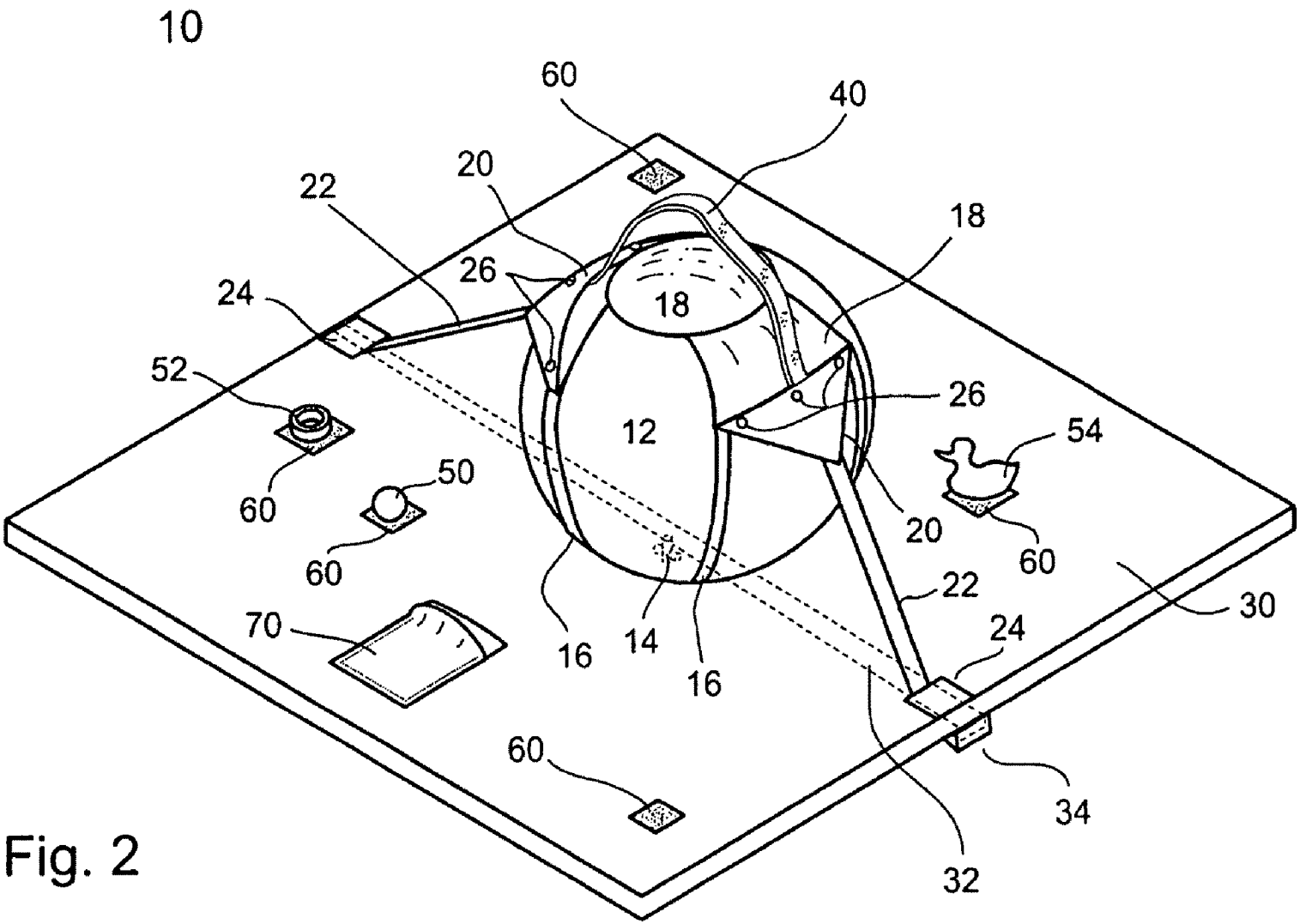
FIG. 2 is a schematic diagram illustrating the exemplary preferred embodiment of the device shown in FIG. 1, absent of the human subject and the adult, in accordance with the present invention.
Figure 3:
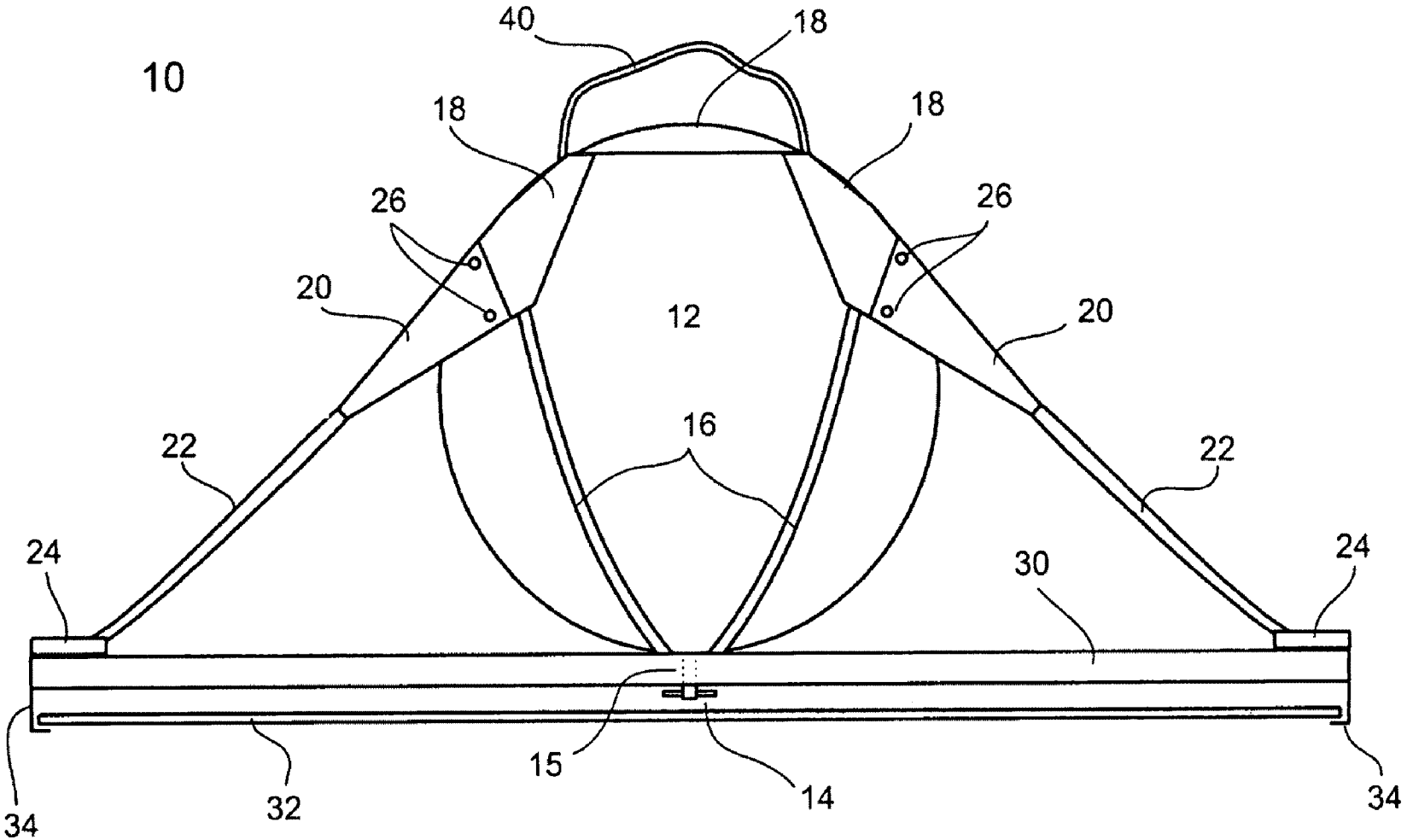
FIG. 3 is a schematic diagram illustrating a side view of the exemplary preferred embodiment of the device shown in FIG. 2, in accordance with the present invention.
Figure 4:
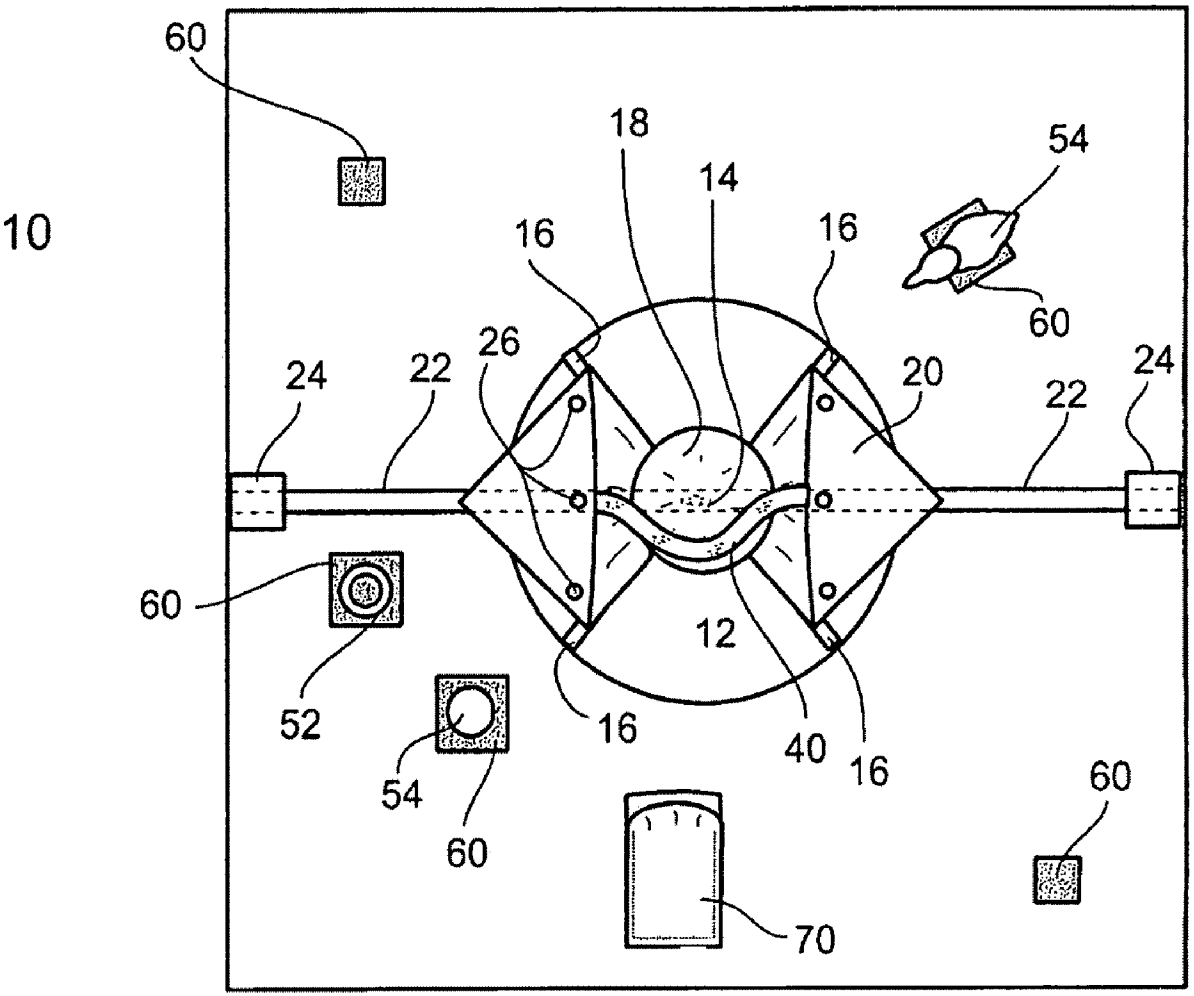
FIG. 4 is a schematic diagram illustrating a top view of the exemplary preferred embodiment of the device shown in FIG. 2, in accordance with the present invention.

Referring now to the drawings, FIG. 1 is a schematic diagram illustrating a perspective view of an exemplary preferred embodiment of the device, and an exemplary preferred embodiment of the method, for occupying a human subject with physical and mental activities, wherein the human mountable and movable object is a ball, and wherein the human subject is an infant assisted by an adult. FIG. 2 is a schematic diagram illustrating the exemplary preferred embodiment of the device shown in FIG. 1, absent of the human subject and the adult. FIG. 3 is a schematic diagram illustrating a side view of the exemplary preferred embodiment of the device shown in FIG. 2. FIG. 4 is a schematic diagram illustrating a top view of the exemplary preferred embodiment of the device shown in FIG. 2. Referenced items (that is, assemblies, sub-assemblies, components, elements, and the human subject) and their associated reference numbers appearing FIGS. 1-4 in the following illustrative description of the present invention generally correspond to the same referenced items and the same associated reference numbers appearing in FIGS. 6-10 of the Examples 1-5, hereinbelow.

As shown in FIGS. 1-4, the device, hereinafter, generally referred to as device 10, for occupying a human subject, hereinafter, referred to as human subject 5, for example, an infant, with physical and mental activities, of the present invention, includes the following main components and functionalities thereof: (a) a human mountable and movable object 12, herein, for brevity, also generally referred to as object 12, having a total volume in a range of between about 0.5 cubic meters and about 5 cubic meters and being sufficiently strong to bear weight of human subject 5 when human subject 5 is mounted thereupon; (b) an object motion control assembly (indicated in FIGS. 1-4 by the operative combination of exemplary components and elements 14, 15 (FIG. 3), 16, 18, 20, 22, 24, and 26) operatively connected to object 12, for controlling motion of object 12 when human subject 5 is mounted upon object 12; and (c) a base assembly 30 operatively connected to object motion control assembly (14, 15 (FIG. 3), 16, 18, 20, 22, 24, and 26), for anchoring the object motion control assembly when human subject 5 is mounted upon object 12 and moving upon object 12 within a field of space determined by characteristics, configuration, and dimensions, of object 12, the object motion control assembly, base assembly 30, and according to behavior of human subject 5.

As shown in FIGS. 1-4, device 10 of the present invention optionally includes various additional components and elements. For example, device 10 optionally includes an infant harness assembly 40, for example, being constructed and configured as a body size adjustable strap, band, cord, or belt, for holding human subject 5 in a position with front, back, or side, upon object 12, in particular, as shown in FIG. 1, or in a sitting position, when mounted upon, and moving on the statically held object 12, or, alternatively, moving on and with the dynamically moving object 12.

Additionally, for example, device 10 optionally includes play or/and educational or learning objects or accessories, for example, a ball 50, a ring 52, and a small toy duck 54, for example, each removably held to base assembly 30 by an adhering element 60, such as Velcro™, and, for example, a pocket 70, capable of holding an object, such as photographs, or paper and markers, for further occupying human subject 5 with physical and mental activities which are applicable in a variety of different fields, particularly, the fields of (mental or/and physical) play, entertainment, education, fitness or exercise, therapy, or/and development.

As shown in FIGS. 1-4, the exemplary preferred embodiment of the device of the present invention, that is, device 10, includes human mountable and movable object 12 being a ball, in order to illustrate implementation of the present invention. It is to be fully understood that in a non-limiting manner the present invention can be generally implemented wherein the device includes any of a wide variety of different types of a human mountable and movable object, for example, a toy animal type of object, instead of a ball type of object.

Human mountable and movable object 12 has a total volume in a range of between about 0.5 cubic meters and about 5 cubic meters and is sufficiently strong to bear weight of human subject 5 when human subject 5 is mounted thereupon. In FIG. 1, human subject 5 is, for example, an infant, and therefore, object 12 is sufficiently strong to bear weight of an infant when the infant is mounted thereupon. In general, object 12 is sufficiently strong to bear weight of a human subject being in any age group, for example, an infant, a child, a young adult, a middle aged adult, and an elderly person, when the human subject is mounted upon object 12.

In general, human mountable and movable object 12 is made of essentially any type or kind of material or combination of materials, so long as object 12 has a total volume in a range of between about 0.5 cubic meters and about 5 cubic meters and is sufficiently strong to bear weight of human subject 5 when human subject 5 is mounted thereupon. Preferably, object 12 is made of material or combination of materials selected from the group consisting of plastics, fabrics, cloths, linens, and combinations thereof. For example, object 12 is made of expandable natural or/and synthetic material or materials, for example, a plastic material, such as nylon, in the form of an inflatable ball which is used while in an inflated state. Alternatively, object 12 is made of non-expandable natural or/and synthetic solid material or materials throughout the inside which is surrounded, enclosed, and covered, by a cover, for example, made of natural or/and synthetic solid material or materials.

Object 12 is made of material which is at least partially non-transparent, at least partly transparent, at least partly opaque, or a combination thereof. The inside or inner volume of object 12 is either completely empty, or is at least partially filled with a liquid, for example, non-colored or colored water, or/and is at least partly filled with any number of various different types of elements, such as play elements, for example, small plastic toy animals or dolls.

Object motion control assembly, indicated in FIGS. 1-4 by the operative combination of exemplary components and elements 14, 15 (FIG. 3), 16, 18, 20, 22, 24, and 26, is operatively connected to object 12, and is operatively connected to base assembly 30, and functions by controlling motion of object 12 when human subject 5 is mounted upon object 12.

In general, the object motion control assembly is made of essentially any type or kind of material or combination of materials, so long as the object motion control assembly controls, in particular, by restraining, the motion of object 12 when human subject 5 is mounted upon object 12. Preferably, the object motion control assembly is made of material or combination of materials selected from the group consisting of plastics, fabrics, cloths, linens, and combinations thereof. For example, as shown in FIGS. 1-4, the object motion control assembly includes an appropriate combination of various straps, bands, cords, and connecting elements, 14, 15 (FIG. 3), 16, 18, 20, 22, 24, and 26. The object motion control assembly can also include length adjusting elements, for adjusting the length of any number of the other elements thereof. Preferably, straps or bands 22 are of a length equal to or less than about 20 cm, for providing safe conditions when human subject 5 is an infant of about three years or less.

For example, for the exemplary preferred embodiment of the device of the present invention, being device 10, the object motion control assembly includes a rotatable connecting element 14 which operatively connects object 12 to the object motion control assembly. Rotatable connecting element 14 extends through a small hole or channel 15 (particularly shown in FIG. 3) passing through the height or depth of base assembly 30. As a result of operative connections among object 12, the object motion control assembly, and base assembly 30, when human subject 5 is mounted upon object 12, human subject 5 and object 12 can freely rotate around a vertical axis of object 12, as well as freely move with object 12 in a rocking or swinging motion relative to a vertical axis of object 12.

Base assembly 30 is operatively connected to object motion control assembly (14, 15 (FIG. 3), 16, 18, 20, 22, 24, and 26), and functions by anchoring the object motion control assembly when human subject 5 is mounted upon object 12 and moving upon object 12 within a field of space determined by characteristics, configuration, and dimensions, of object 12, the object motion control assembly, base assembly 30, and according to behavior of human subject 5.

In general, base assembly 30 is made of essentially any type or kind of material or combination of materials, so long as base assembly 30 anchors the object motion control assembly when human subject 5 is mounted upon object 12 and moving upon object 12. A preferred form of base assembly 30 is, for example, a mat, which is placed on a floor or upon the ground. Preferably, base assembly 30 is made of material or combination of materials selected from the group consisting of plastics, fabrics, cloths, linens, and combinations thereof. For providing stability and firmness to base assembly 30, preferably, base assembly 30 includes a bar or rod 32 extending across the length of a side of base assembly 30, and held in place, preferably on the bottom side underneath base assembly 30, by connecting elements 34, as particularly illustrated in FIG. 3.

For example, base assembly 30 can be a polymeric material based floor mat or mattress, preferably including a cover. Preferably, the inside of such a polymeric material based floor mat or mattress includes a rigid frame or skeletal assembly made of metallic or/and non-metallic materials for providing strength and firmness to, or/and for maintaining shape of, the floor mat or mattress while human subject 5 is mounted upon and moves with object 12. Alternatively, base assembly 30 can be, for example, a piece of cushioned or padded carpet which is firmly located upon a floor, wherein there is appropriate operative connection to the object motion control assembly. Alternatively, for example, base assembly 30 can be a firm or fixed bottom or lower portion of one or more objects selected from the group consisting of a piece of furniture, a wall, a post, a beam, a fence, and a combination thereof, wherein there is appropriate operative connection to the object motion control assembly.

The optional play or/and educational or learning objects or accessories are of essentially any type or kind which are suitable for being operatively connected to base assembly 30, for use by human subject 12 while human subject 12 is mounted upon and moving with object 12. For example, the play or/and educational or learning objects or accessories are any number of various different sized and/or colored geometrical designs, patterns, or, forms or objects, and/or, parts or pieces to a game, made of material operatively connectable to, and removable from, base assembly 30, for example, via Velcro™, or a Velcro™ type of material. Preferably, the play or/and educational or learning objects or accessories are operatively connected to base assembly 30, for use by human subject 5 while human subject 5 is mounted upon and moving with object 12, in a manner appropriately within eyesight of human subject 5 and within reach by the hands or/and feet of human subject 5. The optional play or/and educational or learning objects or accessories are for further occupying human subject 5 with physical and mental activities which are applicable in a variety of different fields, particularly, the fields of (mental or/and physical) play, entertainment, education, fitness or exercise, therapy, or/and development.

The corresponding method for occupying a human subject with physical and mental activities, of the present invention, is herein illustratively described as follows, along with reference to FIGS. 1-4, and further exemplified in FIGS. 5-10 in Examples 1-5, hereinbelow.

In Step (a) of the method, there is providing human subject 5 with a device 10 which comprises: (i) a human mountable and movable object 12 having a total volume in a range of between about 0.5 cubic meters and about 5 cubic meters and being sufficiently strong to bear weight of human subject 5 when human subject 5 is mounted and moving thereupon; (ii) an object motion control assembly (14, 15 (FIG. 3), 16, 18, 20, 22, 24, and 26) operatively connected to object 12, for controlling motion of object 12 when human subject 12 is mounted and moving upon object 12; and (iii) a base assembly 30 operatively connected to the object motion control assembly, for anchoring the object motion control assembly when human subject 5 is mounted and moving upon object 12.

In Step (b), there is mounting of human subject 5 upon object 12.

For implementing the present invention, in the case that human subject 5 is an infant, for example, of about three years or less, then, preferably an adult 7 provides assistance by mounting of the infant upon object 12, as well as supervising the infant when the infant moves upon and with object 12.

For example, in the case that human subject 5 is an infant or a young child, then the infant is mounted upon object 12 by using an infant harness assembly 40, which includes an appropriate combination of straps, bands, cords, connecting elements, and size adjusting elements, preferably, operatively connected to the object motion control assembly, for securely holding the middle portion (back and torso) of an infant in a stomach facing downward laying position while mounted upon and moving with object 12. Alternatively, for example, in the case that human subject 5 is an infant or a young child, then human subject 5 is mounted upon object 12 by using a subject sitting harness assembly, which includes an appropriate combination of straps, bands, cords, connecting elements, and size adjusting elements, preferably, operatively connected to the object motion control assembly, for securely holding the middle and lower portions (waist, torso, and legs) of human subject 5 in a sitting position while mounted upon and moving with object 12.

In Step (c), there is moving of human subject 5 while mounted upon object 12, within a field of space determined by characteristics, configuration, and dimensions, of object 12, the object motion control assembly, base assembly 30, and according to behavior of human subject 5.

Characteristics, configuration, and dimensions, of object 12, the object motion control assembly, and base assembly 30, are in accordance with the actual physicochemical and mechanical characteristics and geometrical dimensions of the combination of straps, bands, cords, connecting elements, and size adjusting elements, thereof.

Human subject 5 mounted upon object 12 is able to controllably and safely move on the statically held object 12, or, alternatively, move on and with the dynamically movable object 12. There are three preferred alternative modes or ways of performing Step (c) of the method, primarily depending upon the extent that the motion of object 12 is controlled by the object motion control assembly—a fixed or static mode, a semi-dynamic mode, and a fully-dynamic mode.

According to the first mode, being a fixed or static mode, of performing Step (c), object 12 is held completely fixed or static by the object motion control assembly, in a manner whereby object 12 remains essentially fixed or static and motionless, and is essentially non-rotatable and non-rockable by human subject 5, when human subject 5 is mounted upon object 12 and moves upon object 12.

According to the second mode, being a semi-dynamic mode, of performing Step (c), object 12 is held by the object motion control assembly, in a manner whereby object 12 is partly rotatable and partly rockable by human subject 5, when human subject 5 is mounted upon object 12 and moves upon object 12.

According to the third mode, being a fully-dynamic mode, of performing Step (c), object 12 is only held at a single point of connection, in particular, at the bottom center of object 12 by rotatable connecting element 14 of the object motion control assembly, in a manner whereby object 12 is fully rotatable around a vertical axis of object 12 and is fully rockable relative to a vertical axis of object 12, by human subject 5, when human subject 5 is mounted upon object 12 and moves upon and with object 12. The fully-dynamic mode of Step (c) is performed in a manner such that when human subject 5 is mounted upon object 12, human subject 5 and object 12 can freely rotate around a vertical axis of object 12, as well as freely move with object 12 in a rocking or swinging motion relative to a vertical axis of object 12.

Above illustratively described novel and inventive aspects and characteristics, and advantages thereof, of the present invention further become apparent to one ordinarily skilled in the art upon examination of the following examples, which are not intended to be limiting. Additionally, each of the various embodiments and aspects of the present invention as delineated herein above and as claimed in the claims section below finds experimental support in the following examples.

EXAMPLES

Reference is now made to the following examples, which together with the above description, illustrate the invention in a non-limiting fashion. In the following Examples 1-5, referenced items (that is, assemblies, sub-assemblies, structures, components, elements, the human subject) and their associated reference numbers appearing in FIGS. 6-10 generally correspond to the same referenced items and the same associated reference numbers appearing in above FIGS. 1-4 which accompany the illustrative description of the present invention.

Example 1

Figure 5:
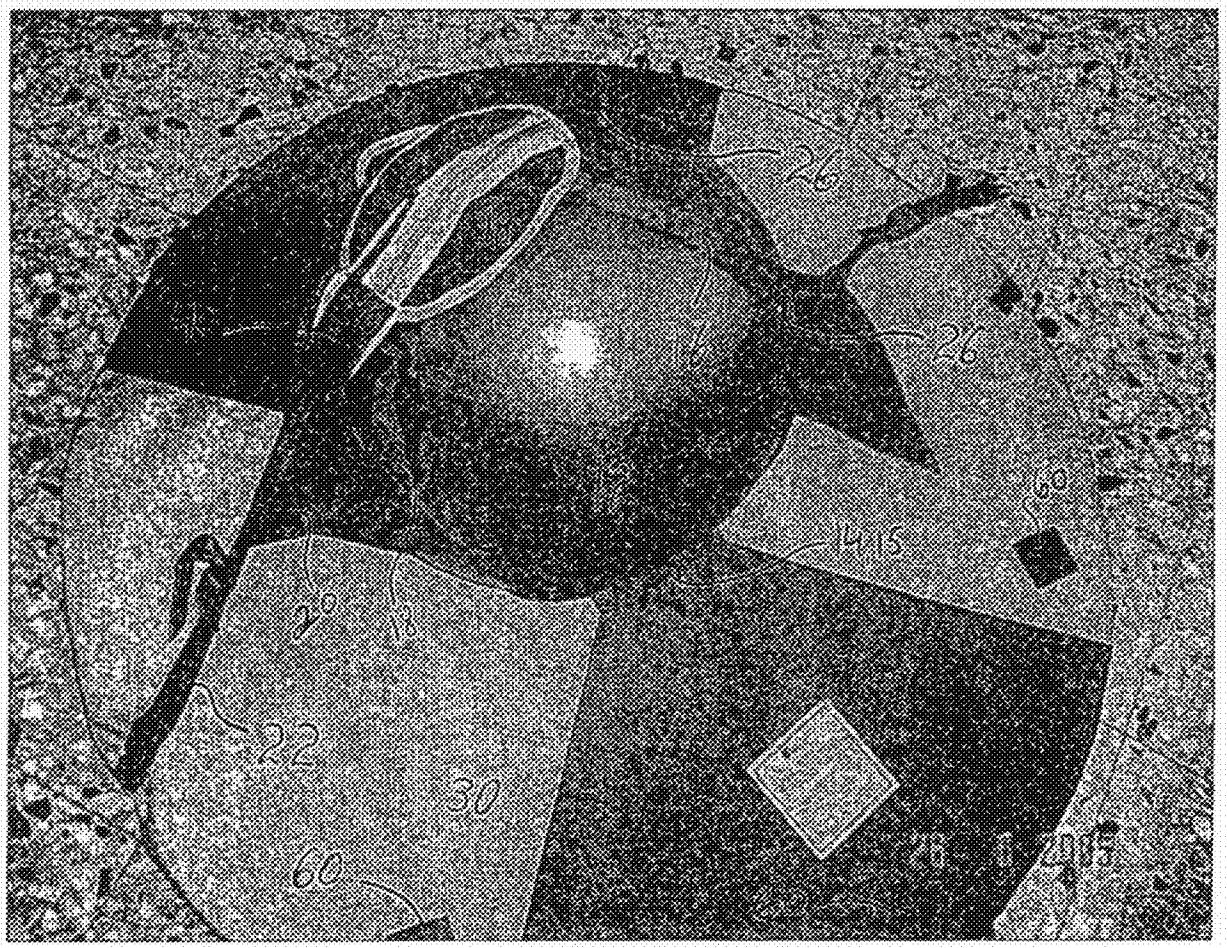
FIG. 5 is a photograph of an actual example of the exemplary preferred embodiment of the device of the present invention schematically illustrated in FIGS. 1-4, wherein the human mountable and movable object 12 is an inflated plastic ball, as described in Example 1, hereinbelow, in accordance with the present invention.

FIG. 5 is a photograph of an actual example of the exemplary preferred embodiment of the device of the present invention schematically illustrated in FIGS. 1-4, and illustratively described hereinabove, wherein the human mountable and movable object 12 is an inflated plastic ball.

Example 2

Figure 6:
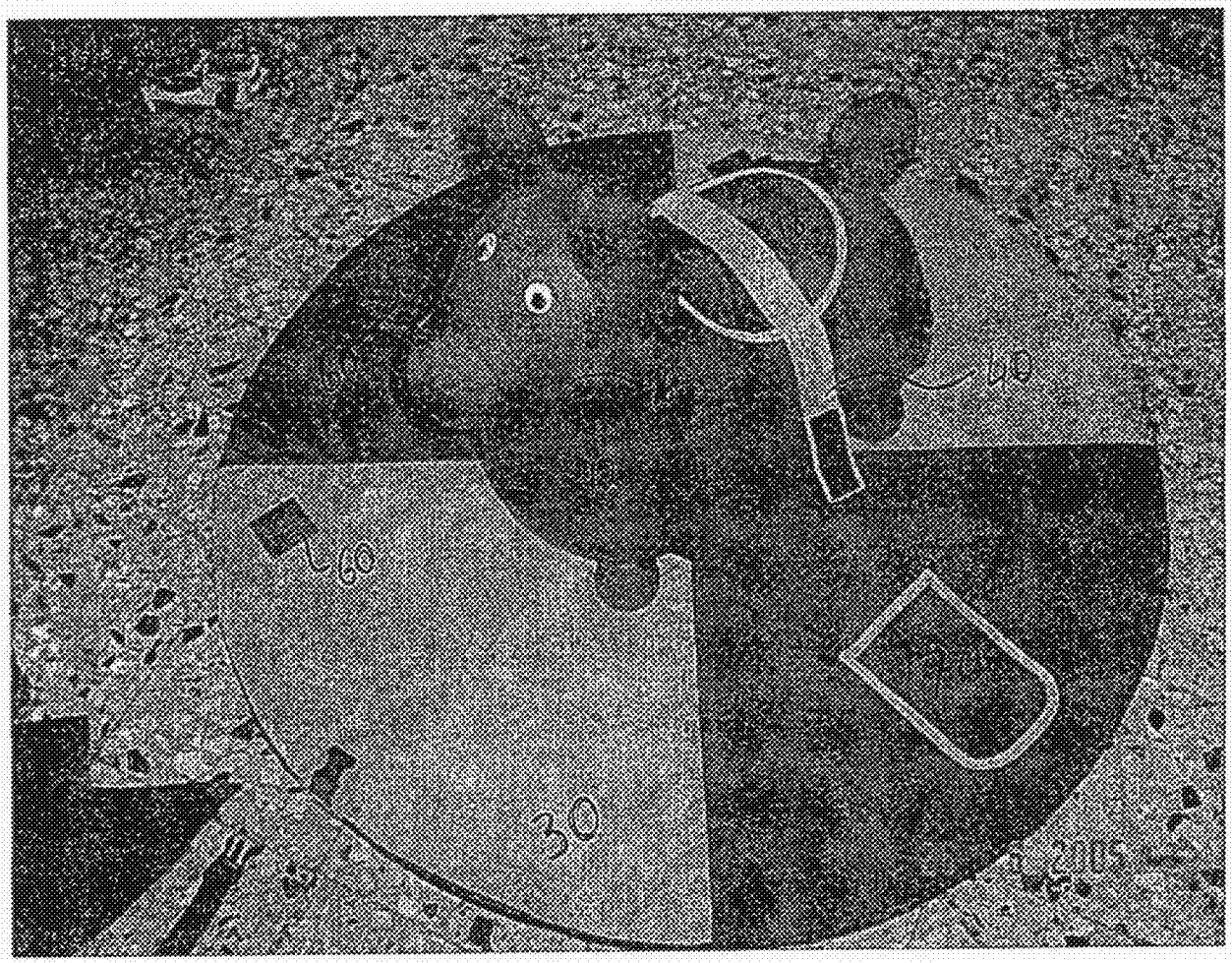
FIG. 6 is a photograph of an actual example of the exemplary preferred embodiment of the device of the present invention schematically illustrated in FIGS. 1-4, wherein the human mountable and movable object 12 is an inflated plastic toy animal, as described in Example 2, hereinbelow, in accordance with the present invention.

FIG. 6 is a photograph of an actual example of the exemplary preferred embodiment of the device of the present invention schematically illustrated in FIGS. 1-4, and illustratively described hereinabove, wherein the human mountable and movable object 12 is an inflated plastic toy animal.

Example 3

Figure 7:
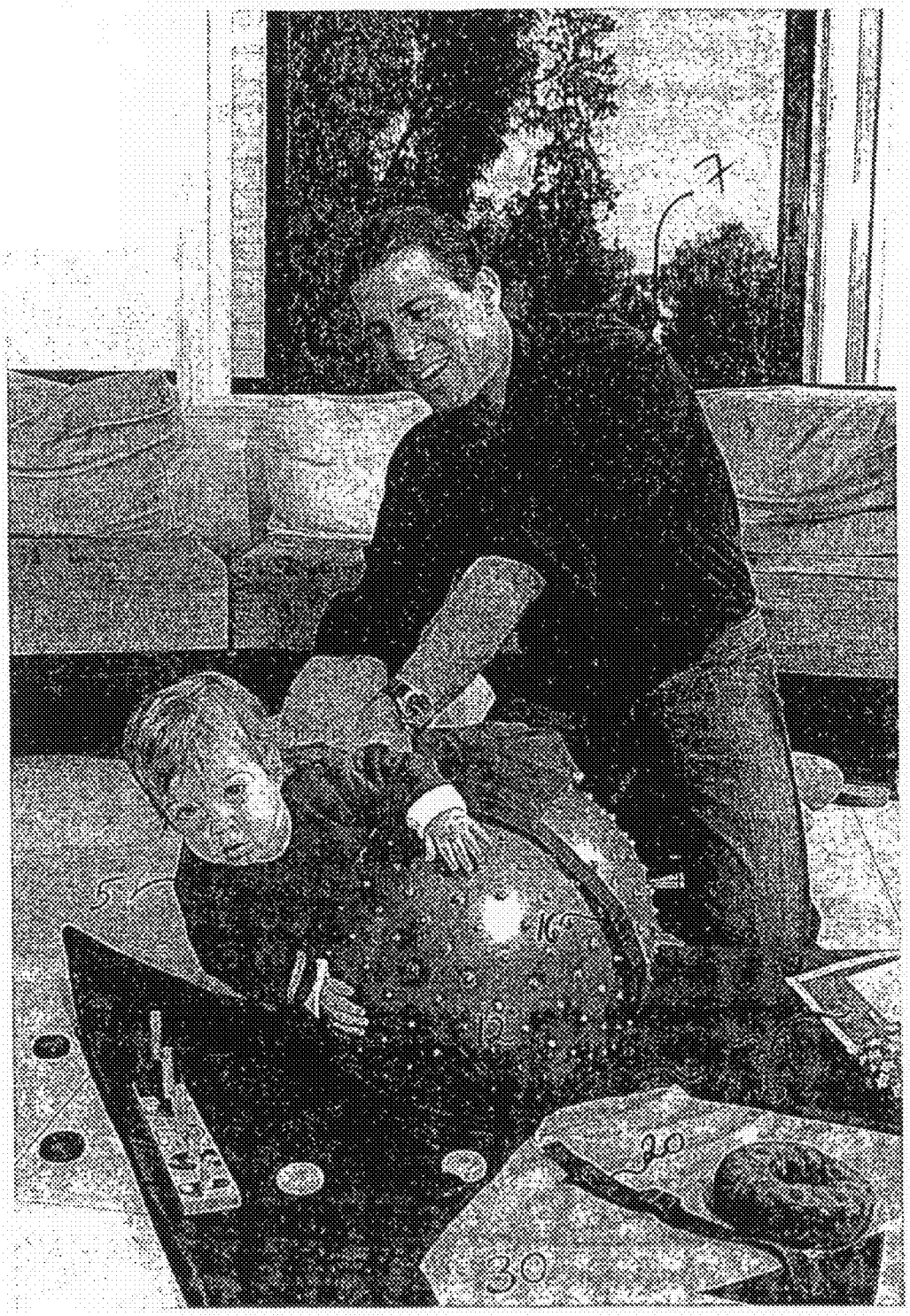
FIG. 7 is a photograph of an actual example of implementing the exemplary preferred embodiment of the device and corresponding method of the present invention schematically illustrated in FIGS. 1-4, wherein the human mountable and movable object 12 is an inflated plastic ball, and wherein the human subject is an infant assisted and supervised by an adult, as described in Example 3, hereinbelow, in accordance with the present invention.

FIG. 7 is a photograph of an actual example of implementing the exemplary preferred embodiment of the device and corresponding method of the present invention schematically illustrated in FIGS. 1-4, and illustratively described hereinabove, wherein the human mountable and movable object 12 is an inflated plastic ball, and wherein the human subject 5 is an infant assisted and supervised by an adult 7.

Example 4

Figure 8:
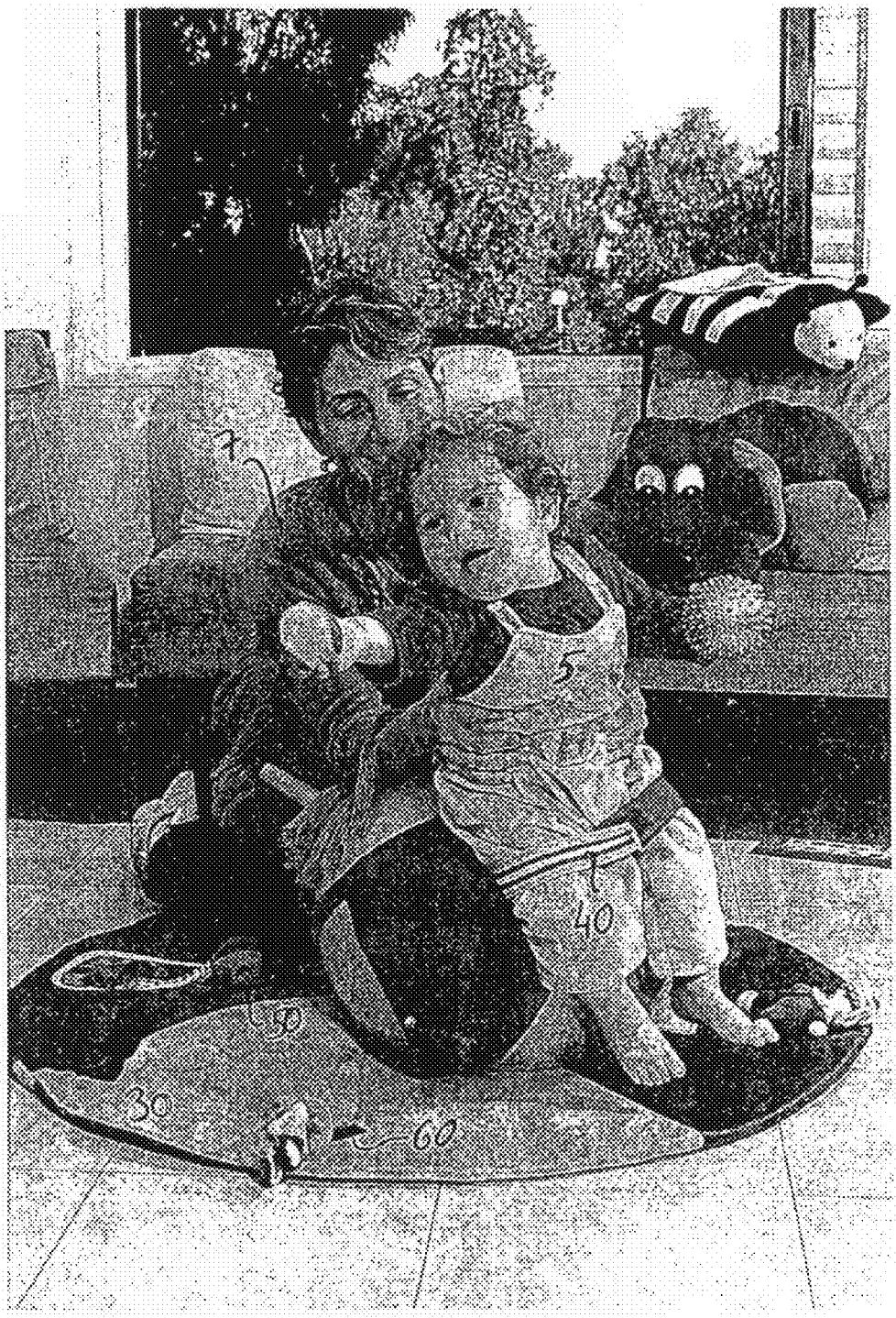
FIG. 8 is a photograph of an actual example of implementing the exemplary preferred embodiment of the device and corresponding method of the present invention schematically illustrated in FIGS. 1-4, wherein the human mountable and movable object 12 is an inflated plastic ball, and wherein the human subject is an infant assisted and supervised by an adult, as described in Example 4, hereinbelow, in accordance with the present invention.

FIG. 8 is a photograph of an actual example of implementing the exemplary preferred embodiment of the device and corresponding method of the present invention schematically illustrated in FIGS. 1-4, and illustratively described hereinabove, wherein the human mountable and movable object 12 is an inflated plastic ball, and wherein the human subject 5 is an infant assisted and supervised by an adult 7. As shown in FIG. 8, the device includes an optional infant harness assembly 40, which includes an appropriate combination of straps, bands, cords, belts, connecting elements, and size adjusting elements, for holding the infant in a sitting position, when mounted upon, and moving on the statically held ball, or, alternatively, moving on and with the dynamically moving ball.

Example 5

Figure 9:
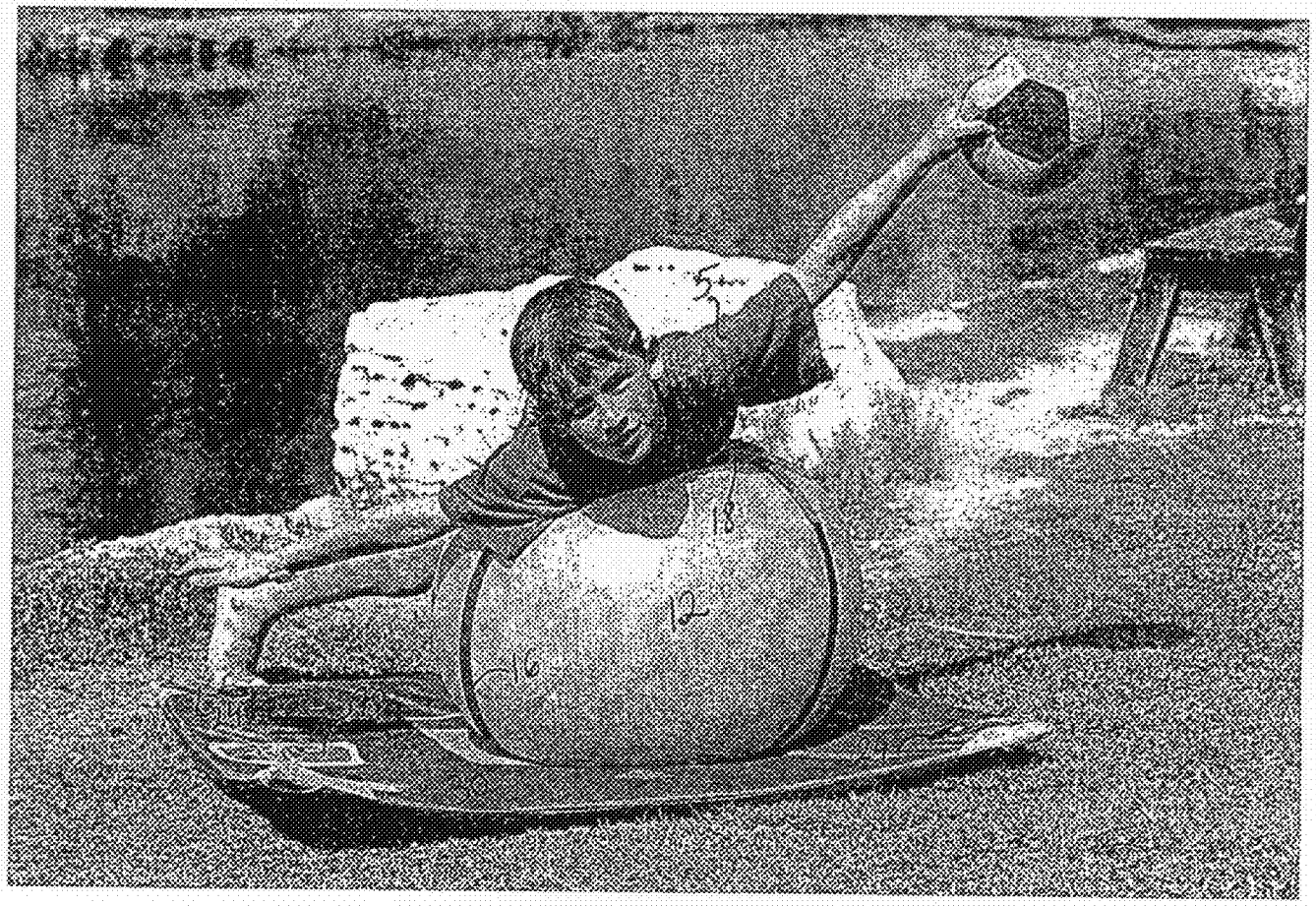
FIGS. 9 and 10 are photographs of actual examples of implementing the exemplary preferred embodiment of the device and corresponding method of the present invention schematically illustrated in FIGS. 1-4, wherein the human mountable and movable object 12 is an inflated plastic ball, and wherein the human subject is a child, as described in Example 5, hereinbelow, in accordance with the present invention.
Figure 10:
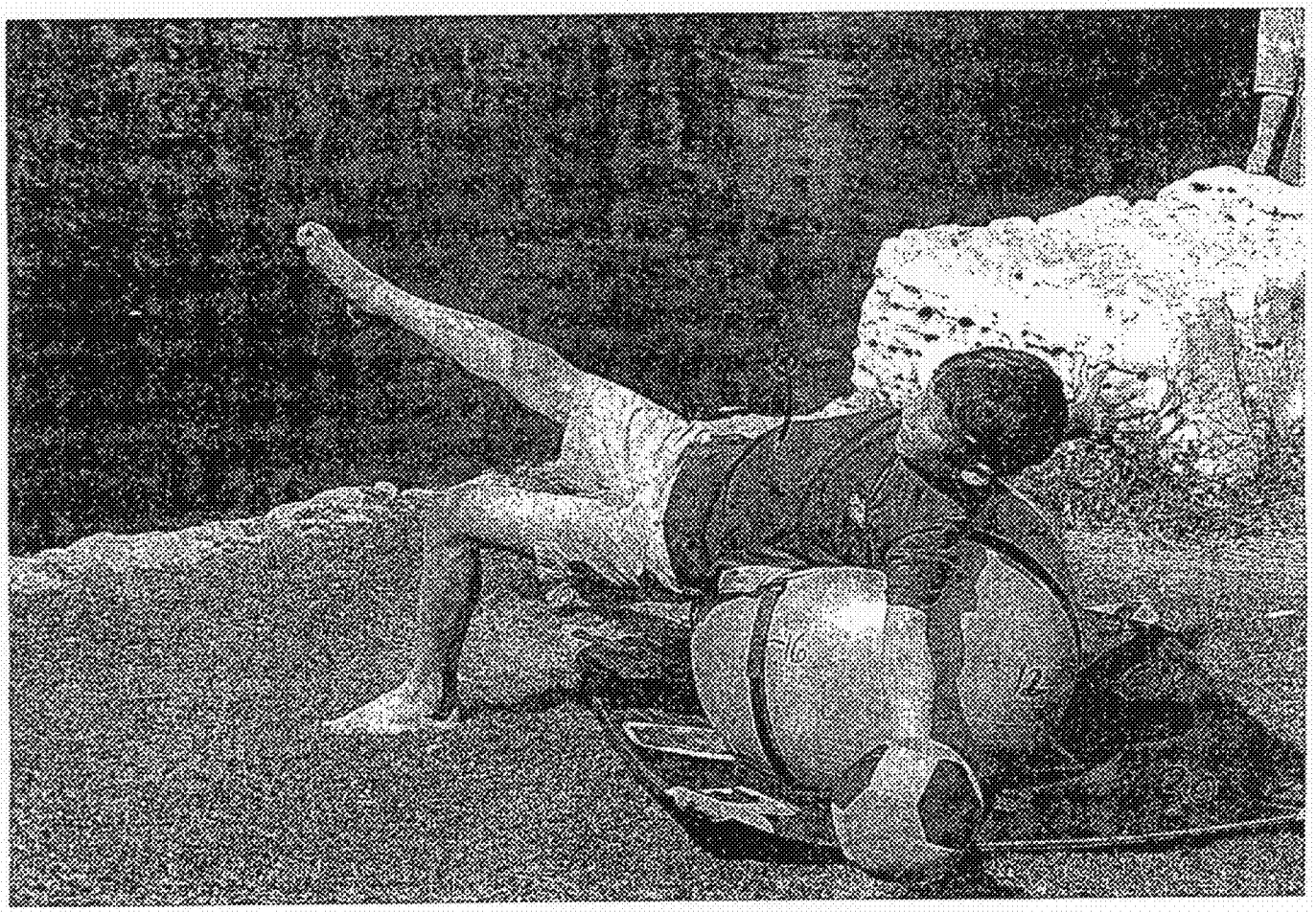

FIGS. 9 and 10 are photographs of actual examples of implementing the exemplary preferred embodiment of the device and corresponding method of the present invention schematically illustrated in FIGS. 1-4, and illustratively described hereinabove, wherein the human mountable and movable object 12 is an inflated plastic ball, and wherein the human subject 5 is a child. In FIG. 9, the front of the child is mounted upon the inflated plastic ball, whereas in FIG. 10, the back of the child is mounted upon the inflated plastic ball.

It is appreciated that certain aspects and characteristics of the invention, which are, for clarity, described in the context of separate embodiments, may also be provided in combination in a single embodiment. Conversely, various aspects and characteristics of the invention, which are, for brevity, described in the context of a single embodiment, may also be provided separately or in any suitable sub-combination.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

While the invention has been described in conjunction with specific embodiments and examples thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A device for occupying a human with physical and mental activities comprising:

(a) a human mountable object having a convex surface on which said mountable object can either rotate or rock;

(b) a base assembly disposed underneath said convex surface; and (c) an object motion control assembly holding said convex surface on said base assembly by way of a strap arrangement, said strap arrangement being configured to hold said human mountable object on said base assembly at selectable tensions including:

(i) a static mode preventing all rotation and rocking, (ii) a semi-dynamic mode allowing rotation and rocking on said base assembly when a force is applied to said object, and (iii) a fully-dynamic mode allowing resistance-free rotation and rocking on said base assembly, so as to enable said human mountable object to roll or to rotate on said base assembly in a controlled manner as a user mounted on said mountable object attempts to maintain a stable position on said mountable object in response to motion of said human mountable mounted object.

2. The device of claim 1, wherein human mountable object includes a ball.

3. The device of claim 2, wherein said ball includes an inflated ball.

4. The device of claim 1, further comprising an infant harness assembly fastened to said human mountable object for mounting an infant onto the device.

5. A method for occupying a human with physical and mental activities comprising:

(a) providing a device including:

(i) a human mountable object having a convex surface on which said object can rotate and can rock;

(ii) a base assembly disposed underneath said convex surface; and (iii) an object motion control assembly holding said convex surface on said base assembly by way of a strap arrangement, said strap arrangement being configured to hold said human mountable object on said base assembly at selectable tensions including:

a. a static mode preventing all rotation and rocking b. a semi-dynamic mode allowing rotation and rocking on said base assembly when a force is applied to said object, c. a fully-dynamic mode allowing resistance-free rotation and rocking on said base assembly, so as to enable said human mountable object to roll or to rotate on said base assembly in a controlled manner as a user mounted on said mountable object attempts to maintain a stable position on said mountable object in response to motion of said human mountable object;

(b) mounting a human being on said human mountable object; and (c) rolling said object so as to engage the human being in attempting to maintain a stable position on said human mountable object.

6. The method for occupying a human with physical and mental activities of claim 5, further comprising selecting a tension at which said human mountable object is held on said base assembly.

7. The method for occupying a human with physical and mental activities of claim 5, further comprising rocking said human mountable object.

* * * * *